US008595971B2

(12) United States Patent
Johnson

(10) Patent No.: US 8,595,971 B2
(45) Date of Patent: Dec. 3, 2013

(54) SYSTEM AND METHOD FOR IMPROVING PERFORMANCE OF A WEAPON BARREL

(71) Applicant: Christopher David Johnson, Crawfordsville, IN (US)

(72) Inventor: Christopher David Johnson, Crawfordsville, IN (US)

( * ) Notice: Subject to any disclaimer, the term of this patent is extended or adjusted under 35 U.S.C. 154(b) by 0 days.

(21) Appl. No.: 13/667,140

(22) Filed: Nov. 2, 2012

(65) Prior Publication Data

US 2013/0247439 A1 Sep. 26, 2013

Related U.S. Application Data

(63) Continuation-in-part of application No. 12/727,074, filed on Mar. 18, 2010, now Pat. No. 8,312,663.

(60) Provisional application No. 61/585,264, filed on Jan. 11, 2012, provisional application No. 61/161,370, filed on Mar. 18, 2009.

(51) Int. Cl.
*F41A 21/00* (2006.01)

(52) U.S. Cl.
USPC ..... 42/97; 42/76.01; 42/76.02; 89/14.05

(58) Field of Classification Search
USPC ..... 42/97, 76.01, 76.02; 89/14.05
See application file for complete search history.

(56) References Cited

U.S. PATENT DOCUMENTS

| | | | | |
|---|---|---|---|---|
| 5,794,374 | A | 8/1998 | Crandall | |
| 5,798,473 | A | 8/1998 | Roblyer | |
| 6,889,462 | B1 | 5/2005 | Carlson | |
| 8,196,701 | B1 * | 6/2012 | Oliver | 181/223 |
| 8,261,651 | B2 * | 9/2012 | Casas Salva | 89/14.4 |
| 8,312,663 | B2 * | 11/2012 | Johnson | 42/97 |
| 8,347,544 | B1 * | 1/2013 | Swan | 42/124 |
| 2010/0132241 | A1 * | 6/2010 | Mancini | 42/76.02 |
| 2012/0227302 | A1 * | 9/2012 | Fonte | 42/78 |

* cited by examiner

*Primary Examiner* — J. Woodow Eldred
(74) *Attorney, Agent, or Firm* — Ice Miller LLP

(57) ABSTRACT

A viscoelastic barrel dampener operable to increase the accuracy of a weapon having a shroud, the shroud defining a shroud wall and a chamber within the shroud wall, a barrel, the barrel disposed within the chamber of the shroud and defining a barrel wall having an outer surface, and a viscoelastic dampening material, the viscoelastic dampening material disposed within and substantially filling a volume defined by the outer surface of the barrel and the shroud wall, wherein the barrel further includes one or more contour features adapted to disrupt the axial propagation of acoustic energy along the barrel wall. In at least one embodiment, the one or more contour features may include a plurality of parallel barrel walls, radial grooves, or steps formed in the outer surface.

20 Claims, 9 Drawing Sheets

SYSTEM AND METHOD FOR IMPROVING PERFORMANCE OF A WEAPON BARREL

PRIORITY

The present application is related to, and claims the priority benefit of, U.S. patent application Ser. No. 12/727,074, filed Mar. 18, 2010, and U.S. Provisional Patent Application Ser. Nos. 61/161,370, filed Mar. 18, 2009, and 61/585,264, filed Jan. 11, 2012. The contents of each of these applications are hereby incorporated by reference in their entirety into this disclosure.

BACKGROUND

Sniper rifles and other high-accuracy guns and artillery are designed to repeatedly deliver a projectile accurately and precisely. However, variations and other effects within the barrel, including perturbations caused by acoustic disturbances produced by the act of firing, can cause substantial changes to the trajectory or flight path of a projectile, thereby causing a decrease in accuracy. Currently, methods for reducing such perturbations typically relate to devices operable to mechanically stabilize a muzzle at the point where the bullet exits the barrel, such as those discussed in U.S. Pat. No. 5,794,374, or the use of movable counterweights such as those marketed under the mark Limbsaver®. Other methods for reducing such perturbations include U.S. Pat. Nos. 5,798,473 and 6,889,462, which utilize a spring system for tensioning a barrel until its "sweet spot" is found to reduce variability in the accuracy of a weapon barrel. Additionally, many of the aforementioned methods exhibit dramatic degradations in performance as the temperature of the weapon barrel increases.

It would be appreciated in the art to supply a system and method for reducing the variability induced in a barrel through a range of acoustic disturbances without the need to iteratively tension and/or counterbalance then field test each spring loading configuration or counterweight position for each individual barrel and ammunition type. The elimination of movable components that might loosen or break also would be appreciated in the art. Therefore, there is a need for a system and method of improving the performance of a weapon barrel that overcomes the limitations of the prior art without adding weight to the weapon, especially in military systems where any weight penalty is of critical importance.

BRIEF SUMMARY

The present disclosure includes disclosure of systems and methods for improving the performance of a weapon barrel. In at least one embodiment, the present disclosure includes disclosure of a viscoelastic barrel dampener operable to increase the accuracy of a weapon having a shroud, the shroud defining a shroud wall and a chamber within the shroud wall, a barrel, the barrel disposed within the chamber of the shroud and defining a barrel wall having an outer surface, and a viscoelastic dampening material, the viscoelastic dampening material disposed within and substantially filling a volume defined by the outer surface of the barrel and the shroud wall, where the barrel further includes one or more contour features adapted to disrupt the axial propagation of acoustic energy along the barrel wall. In at least one embodiment, the one or more contour features may include a plurality of parallel barrel walls, radial grooves, or steps formed in the outer surface.

In at least one embodiment, the present disclosure includes disclosure of a viscoelastic barrel dampener where the one or more contour features are further capable of decreasing an acoustic reflectivity of the outer surface and increasing the transmittance of acoustic energy to the viscoelastic dampening material.

In at least one embodiment, the present disclosure includes disclosure of a viscoelastic barrel dampener with a shroud cap attached to the barrel at a muzzle end of the barrel, whereby the shroud cap applies an axial tensile force to the barrel and an opposing axial compressive force in the shroud wall. In at least one embodiment, a viscoelastic barrel dampener includes one or more tension devices disposed between the shroud and the shroud cap, whereby the one or more tension devices maintain tension in the barrel over a range of operating temperatures In at least one embodiment, the present disclosure includes disclosure of a viscoelastic barrel dampener where the viscoelastic dampening material is attenuates a spectrum of vibrational frequencies generated by the barrel in operation. In at least one embodiment, the viscoelastic dampening material is an elastomeric polymer exhibiting hysteresis in response to being deformed. In at least one embodiment, the viscoelastic dampening material is selected from a group consisting of epoxy and polysulfide compounds. In at least one embodiment, the viscoelastic dampening material is poured into the volume defined by the outer surface of the barrel and the shroud wall in an unpolymerized state and allowed to cure in situ.

In at least one embodiment, the present disclosure includes disclosure of a viscoelastic barrel dampener having an outer member defining a chamber and an outer surface, a weapon barrel, with an exterior surface, disposed within the chamber of the outer member, where the outer member is sized to substantially enwrap the barrel and is adapted to provide a constraining layer, and a viscoelastic dampening material substantially filling a volume defined within the chamber of the outer member between the outer surface and the exterior surface of the barrel, where the viscoelastic dampening material is capable of attenuating acoustic vibrational energy across a spectrum of vibrational frequencies generated by the barrel in operation via elastic hysteresis properties of the viscoelastic dampening material, and where the exterior surface of the barrel comprises one or more contour features adapted to disrupt the axial propagation of acoustic energy along the barrel, the one or more contour features include a plurality of radial grooves and one or more steps.

In at least one embodiment, the present disclosure includes disclosure of a viscoelastic barrel dampener where the one or more contour features comprise the barrel wall having one or more sections of uniform thickness. In at least one embodiment, the one or more contour features are further adapted to decrease the acoustic reflectivity of the outer surface and increase the transmittance of acoustic energy to the viscoelastic dampening material. In at least one embodiment, a viscoelastic barrel dampener includes a shroud cap attached to the barrel at a muzzle end of the barrel, whereby the shroud cap applies an axial tensile force to the barrel and an opposing axial compressive force in the shroud wall. In at least one embodiment, a viscoelastic barrel dampener includes one or more tension devices disposed between the shroud and the shroud cap, whereby the one or more tension devices maintain tension in the barrel over a range of operating temperatures. In at least one embodiment, one or more tension devices are disposed between the shroud cap and a compensator attached at the muzzle end of the barrel, whereby the one or more tension devices maintain tension in the barrel over a range of operating temperatures.

In at least one embodiment, the present disclosure includes disclosure of a weapon including a viscoelastic barrel dampener, the viscoelastic barrel dampener including a shroud, the shroud defining a shroud wall and a chamber within the shroud wall, a barrel, the barrel disposed within the chamber of the shroud and defining a barrel wall having an outer surface, and a viscoelastic dampening material, the viscoelastic dampening material disposed within and substantially filling a volume defined by the outer surface of the barrel and the shroud wall, where the barrel further includes one or more contour features capable of decreasing an acoustic reflectivity of the outer surface and increasing the transmittance of acoustic energy to the viscoelastic dampening material. In at least one embodiment, the weapon is a rifle.

BRIEF DESCRIPTION OF THE DRAWINGS

The above mentioned embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION

Figure 1:
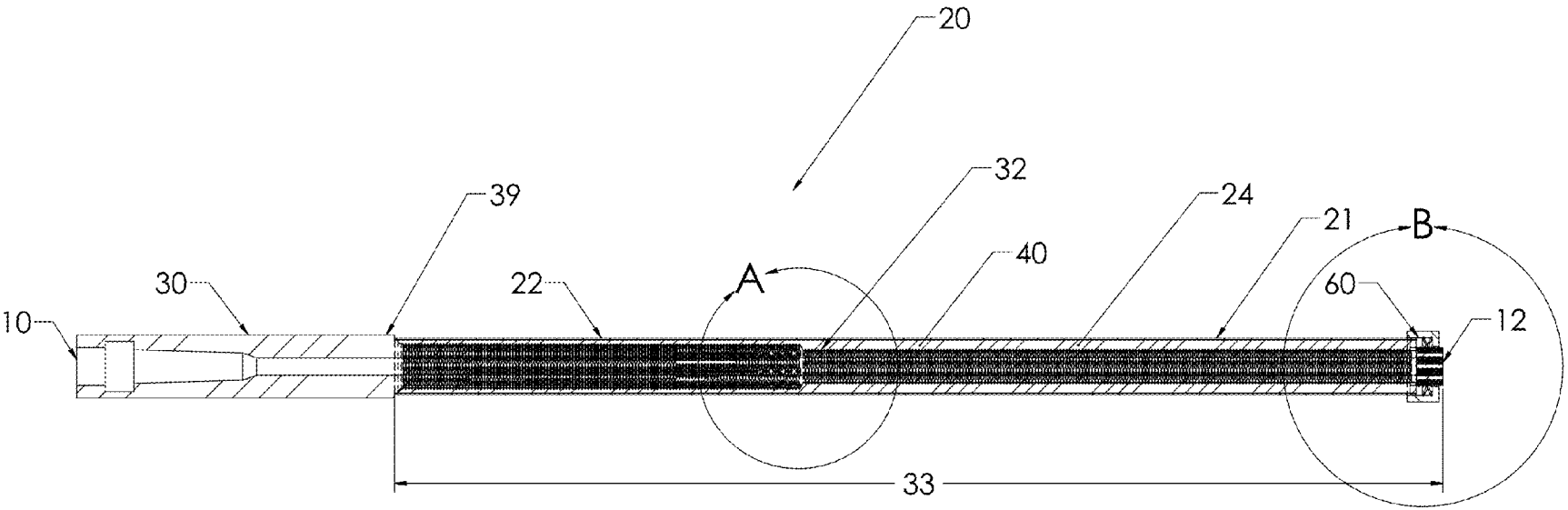
FIG. 1 shows a cut-away plan view of a weapon barrel having a viscoelastic barrel dampener, according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended. The disclosure of the present application includes systems and methods for improving the performance of a weapon barrel included in a weapon assembly by reducing the mass of the barrel and by creating a high-loss, acoustic waveguide, which attenuates and absorbs acoustic vibrational energy over a range of frequencies produced in the barrel by the combustion of propellant when firing the weapon, thereby improving performance and accuracy.

An exemplary embodiment of a viscoelastic barrel dampener of the present disclosure is shown in FIG. 1. As shown in FIG. 1, a viscoelastic barrel dampener 20 may include a contoured weapon barrel 30 substantially surrounded by a viscoelastic dampening material 40 and a barrel shroud 21. The weapon barrel 30 may include a substantially cylindrical tube or tubular portion having an outer surface 32, a contoured length 33, an action end 10, an opposing muzzle end 12, and a shoulder 39 near the action end 10. The barrel shroud 21 may be formed to substantially encase or enwrap a significant portion of the weapon barrel 30.

Figure 2:
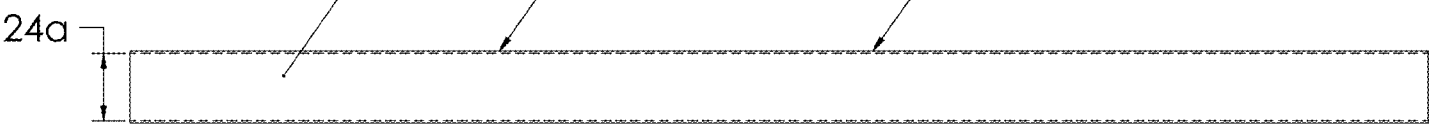
FIG. 2 shows a plan view of a barrel shroud for a viscoelastic barrel dampener, according to at least one embodiment of the present disclosure.

In at least one embodiment according to the present disclosure as shown in FIG. 2, the barrel shroud 21 may include a substantially cylindrical tube or tubular portion having an outer surface 22 and an interior chamber 24 defined within the outer surface 22. The barrel shroud 21 may be formed with a diameter 24*a* large enough to encase the barrel 30 along the contoured length 33 from or near the action end 10 to or near the muzzle end 12. In at least one embodiment, the barrel shroud 21 may seat against the shoulder 39 toward the action end 10 of the barrel 30. The barrel shroud 21 may be formed of a metal (e.g., titanium), alloy, polymer, composite, fiberglass, carbon fiber, or other suitable material. The choice of material for the barrel shroud 21 may be a factor in reducing the weight of a weapon assembly incorporating the viscoelastic barrel dampener 20. By way of non-limiting example, the barrel shroud 21 may be a 28.6 millimeter (mm) (1.125 inch (in.)) diameter titanium tube.

As shown in FIG. 1, the viscoelastic barrel dampener 20 may include the viscoelastic acoustic dampening material 40 at least partially filling the chamber 24, thereby substantially encasing or enwrapping a substantial portion of the length 33 of the barrel 30. The viscoelastic acoustic dampening material 40 is capable of attenuating and absorbing vibrations from the weapon barrel 30 across a wide range of frequencies as described further herein.

Figure 3:
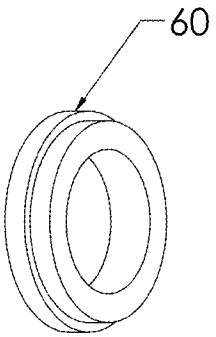
FIG. 3 shows an isometric view of a shroud cap for a viscoelastic barrel dampener, according to at least one embodiment of the present disclosure.

In at least one embodiment according to the present disclosure as shown in FIGS. 1 and 3, the viscoelastic barrel dampener 20 may include a shroud cap 60 attached to the barrel 30 at or near the muzzle end 12. The shroud cap 60 may contact the barrel shroud 21 and force the shroud 21 against the shoulder 39 such that an axial compressive force is applied to the barrel shroud 21, resulting in an equal and opposite axial tensile force applied to the barrel 30. The shroud cap 60 may include a threaded opening formed through the center of the cap 60, thereby enabling the cap 60 to be screwed onto mating threads formed in the barrel 30 at or near the muzzle end 12. Alternatively, the shroud cap 60 may be attached to the barrel 30 by any suitable means that enables the shroud cap 60 to apply an axial compressive force to the barrel shroud 21 while generating an equal and opposite axial tensile force applied to the barrel 30.

Figure 4:
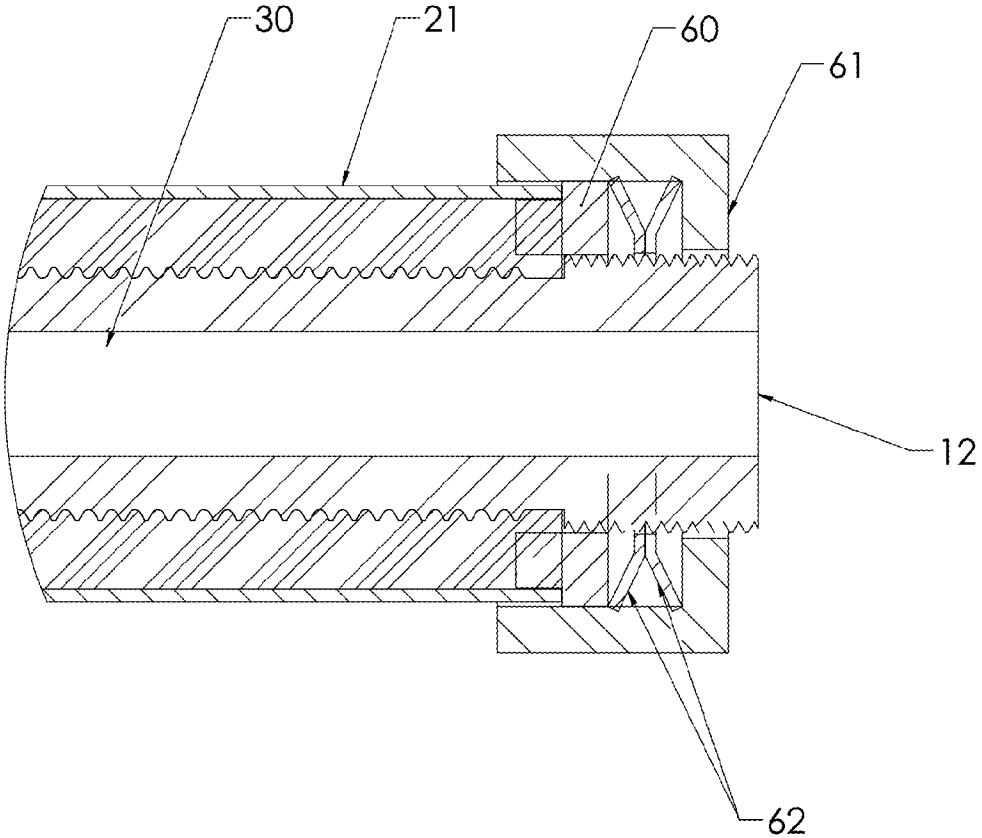
FIG. 4 shows a plan detail view of a weapon barrel with a viscoelastic barrel dampener taken at perspective area B of FIG. 1, according to at least one embodiment of the present disclosure.

As shown in FIG. 4, the viscoelastic barrel dampener 20 may include one or more tension devices 62 to generate and substantially maintain tension in the barrel 30. In operation, the temperature of the barrel 30 will increase as the weapon is fired. Because the barrel 30 and the barrel shroud 21 potentially may be of different materials such that the barrel 30 may have a different coefficient of thermal expansion than the barrel shroud 21, and because the barrel 30 typically operates at a higher temperature than will be maintained in the barrel shroud 21, the tension in the barrel 30 generated by the shroud cap 60 may be relieved if the barrel 30 increases length 33 faster than the barrel shroud 21 for a given operating condition. In at least one embodiment as shown in FIG. 4, the one or more tension devices 62 may be conical spring washers (commonly known as Belleville washers) arranged in series, parallel or a combination thereof and held in place by an end cap 61 to maintain tension in the barrel 30. In at least one embodiment, tension may be generated in the barrel 30 by applying a torque of 110 inch-pounds to the shroud cap 60. In operation, where the one or more tension devices 62 are conical spring washers, the tension devices 62 maintain tension in the barrel 30 by flexing continuously and predictably even as the barrel 30 lengthens due to heat generated by the weapon. Alternatively, the one or more tension devices 62 may include lock washers, coil springs, wavy washers, hydraulic or pneumatic recuperators, or active feedback systems designed to maintain a specific tension level in the barrel 30.

In at least one embodiment, the shroud cap 60 may be threaded internally and may engage threads formed in the barrel 30 at or near the muzzle end 12, thereby directly contacting the barrel shroud 21 and generating the desired tensile and compressive forces described herein. Alternatively, the shroud cap 60 may be retained in position at the muzzle end 12 by a compensator (commonly known as a muzzle brake and not shown here), which redirects propellant gases exiting the muzzle end 12 of the barrel 30 with the effect of countering both recoil of the weapon and unwanted elevation of the barrel 30 during operation of the weapon.

In at least one embodiment according to the present disclosure, the viscoelastic dampening material 40 may be a non-linear elastomeric, polymeric compound capable of dampening acoustic, vibrational, and thermal anomalies of the barrel 30 under the operating conditions of the weapon. Acoustic and vibrational energy generated by the weapon when fired is propagated axially through the barrel 30 at various frequencies depending on the structure and material of the barrel 30, the ammunition used, the operating temperature of the barrel 30, and other factors. The viscoelastic acoustic dampening material 40 is capable of attenuating and absorbing vibrations from the weapon barrel 30 across a wide range of frequencies. Thus, the viscoelastic barrel dampener 20 need not be tuned, adjusted, or configured for a specific barrel 30 or operating condition. Instead, the viscoelastic acoustic dampening material 40 enables the viscoelastic barrel dampener 20 to effectively attenuate all frequencies generated by the barrel 30 when the weapon is fired. In at least one embodiment, the viscoelastic dampening material 40 may be a polysulfide non-linear elastomeric material that retains viscoelastic properties over a range of temperatures of at least −40° F. to 250° F. By way of non-limiting example, the viscoelastic dampening material 40 may be a two-component, chemically-cured polysulfide sealant such as Product 964 (sold by Epoxy.com a Division of Epoxy Systems, Inc., 20774 W. Pennsylvania Ave., Dunnellon, Fla. 34431).

In at least one embodiment according to the present disclosure, the viscoelastic dampening material 40 further reduces the acoustic reflectivity and vibrational displacement along the weapon barrel surface 32. A reduction in the acoustic reflectivity and vibrational displacement is advantageous because the surface of a conventional weapon barrel acts as an acoustic waveguide with a generally smooth, tapered or frustroconcial shape that acts to concentrate acoustic energy at the apex of the cone (i.e., the muzzle end 12 of the barrel 30). The acoustic energy generated by the rapidly burning propellant in a chamber at the action end of a conventional barrel travels, with little loss, down the narrowing barrel, which focuses the acoustic energy at the muzzle end, producing a displacement at precisely the most critical region for weapon accuracy. Further, the acoustic energy travels repeatedly back and forth between the action end and muzzle end before a projectile can exit the muzzle end. The result is a tendency for displacement of the muzzle end when the weapon is fired, causing muzzle deviation and negatively affecting the accuracy of the weapon.

The viscoelastic dampening material 40 reduces the reflectivity of acoustic energy at the boundary layer between the barrel surface 32 and its surroundings (i.e., ambient air if not encapsulated), which provides an energy sink for the accuracy-degrading acoustic vibrational energy. Moreover, the acoustic vibrational energy generated by firing the weapon causes displacements within the viscoelastic dampening material 40, which are constrained by the barrel shroud 21. Further, because the viscoelastic dampening material 40 exhibits elastic hysteresis the constrained displacements dissipate additional acoustic vibrational energy in the form of heat as the viscoelastic dampening material 40 is forced by the barrel shroud 21 to return to its initial state within the chamber 24 of the barrel shroud 21.

In at least one embodiment of the present disclosure, the elastic hysteresis of the viscoelastic dampening material 40 exemplifies an irreversible thermodynamic system, which requires energy to return to its initial state or configuration. Consequently, deformation of or displacement within the viscoelastic dampening material 40 requires more energy to recover its shape than was required to effect the deformation, where the presence of the constraining barrel shroud 21 forces the viscoelastic dampening material 40 to return to its initial configuration. Within the viscoelastic barrel dampener 20, the source of energy to produce the hysteresis response is the acoustic vibrational energy generated by firing the weapon.

In effect, the barrel shroud 21 is a constraint to the displacement of the viscoelastic dampening material 40 that forces the material 40 to seek an initial configuration and to dissipate the excess energy as heat. As a result, the energy used to return the viscoelastic dampening material 40 to the initial configuration is no longer available to deflect or displace the barrel 30, particularly the muzzle end 12. The conversion of vibrational energy in the barrel 30 into thermal energy in the viscoelastic dampening material 40 via elastic hysteresis, which is promoted by the overlaying constraining layer of the barrel shroud 21, is an example of the fundamental nature of a phenomenon commonly known as constrained-layer damping.

By way of example, a reflectivity R of an air-steel boundary is given by Eq. 1:

$$R=((Z_2-Z_1)/(Z_2+Z_1))^2 \quad \text{(Eq. 1)}$$

where $Z_1=Z_{steel}=4.7\times10^7$; $Z_2=Z_{air}=415$, or $Z_2=Z_{viscoelastic}=1.8\times10^6$.

For a single acoustic reflection, the reflectivity for an air-steel boundary is very nearly 1.00, and for a viscoelastic-steel boundary the reflectivity is 0.857. However, because the acoustic energy repeatedly reflects within the barrel, the cumulative acoustic reflectivity is the product of each successive reflection. To determine the cumulative reflectivity, the result of Eq. 1 is multiplied by the Eq. 1 for each successive reflection. Thus, the cumulative reflectivity for 20 successive reflections across a viscoelastic-steel boundary is only 0.046 compared to the 0.999 for 20 successive reflections across the typical air-steel boundary, which represents a significant decrease in acoustic energy retained within the barrel. Energy not reflected within the barrel is transmitted to the viscoelastic dampening material 40, which absorbs the transmitted energy and dissipates the energy as heat via the elastic hysteresis properties of the viscoelastic dampening material 40 under constraint from the shroud 21.

Figure 5:
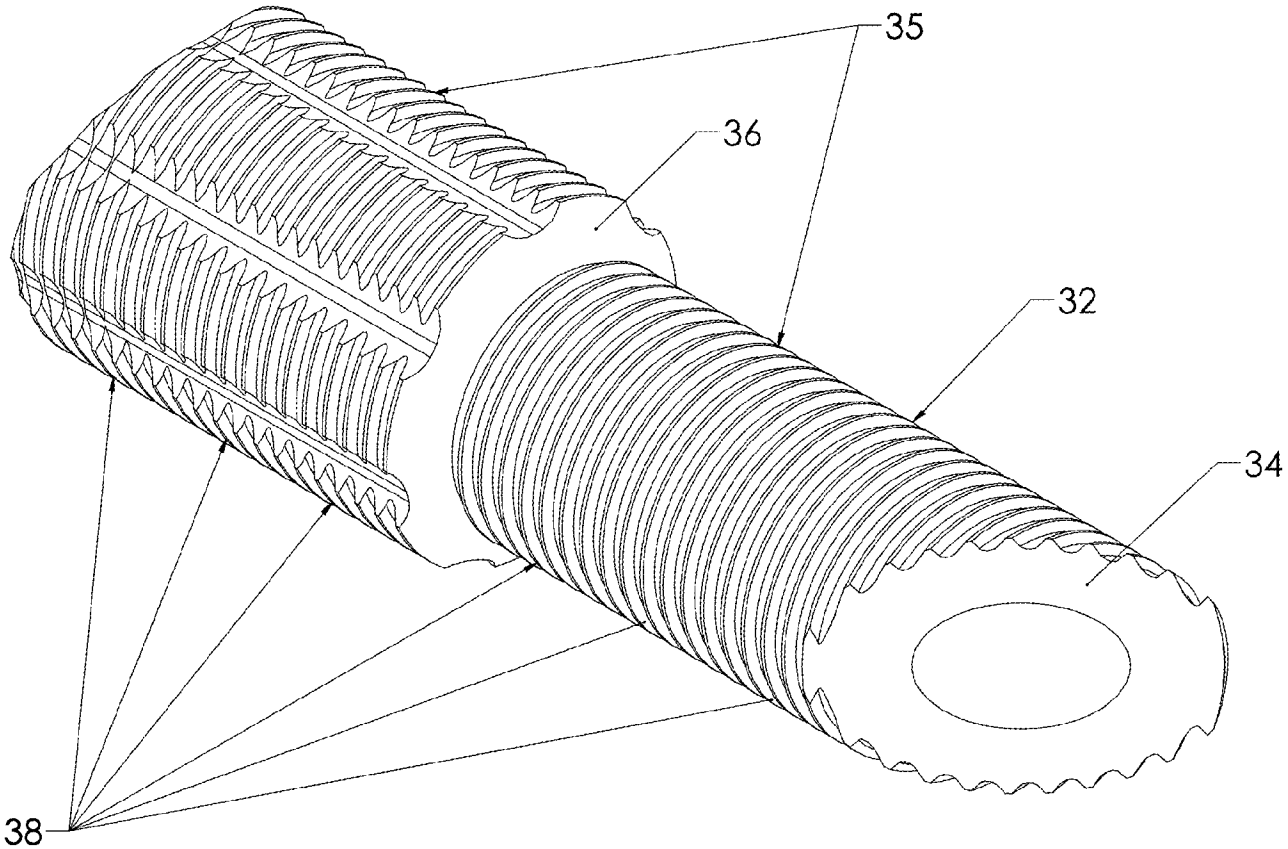
FIG. 5 shows a isometric detail view of a weapon barrel with a viscoelastic barrel dampener taken at perspective area A of FIG. 1, according to at least one embodiment of the present disclosure.

In at least one embodiment according to the present disclosure, a viscoelastic barrel dampener 20 may include a contoured barrel 30 that includes one or more parallel barrel walls 34, a plurality of radial, spiral, or axial grooves 38, and one or more barrel steps 36. As shown in FIG. 5, the contoured barrel 30 may include one or more parallel barrel walls 34 formed axially along the principal axis of the barrel 30. Unlike the frustoconcial shape of a conventional weapon barrel described herein, the one or more parallel barrel walls 34 have a uniform thickness along a given barrel section 35. Due to the uniform thickness, the one or more parallel barrel walls 34 facilitate the development of multiple internal reflections that operate to disrupt the propagation of acoustic energy along the barrel 30 and to provide multiple opportunities for acoustic energy to leave the barrel 30 and enter the viscoelastic dampening material 40. Moreover, in at least one embodiment, the contoured barrel 30 may include a plurality of grooves 38 that further disrupt the propagation of acoustic energy along the barrel 30 by increasing internal scatter and loss from the barrel surface 32, as well as increasing the barrel surface area which further facilitates acoustic energy loss. The plurality of grooves 38 may be formed radially, axially, or helically in the exterior surface 32 of the barrel 30. Furthermore, in at least one embodiment, the contoured barrel 30 may include one or more barrel steps 36 that enable additional material to be eliminated from the muzzle end 12 of the barrel 30 while maintaining sufficient strength at the action end 10, where temperatures and stresses are highest. The one or more barrel steps 36 also function to disrupt the waveguide characteristics of the barrel 30. Because the principle operating frequency of an acoustic waveguide is strongly dependent on the diameter of the waveguide, the one or more steps 36 create two or more separate barrel sections 35, each with a unique optimal transmission frequency, as shown in FIG. 5. As a result, multi-frequency acoustic vibrational energy that may transmit best along one barrel section 35 will not be as readily transmitted in an adjacent barrel section 35 having a different diameter. Therefore, the one or more barrel steps 36 increase the effective transmittance loss of the barrel 30 as each step produces an acoustic impedance mismatch and fundamentally changes the waveguide nature of the barrel 30.

Consequently, a contoured barrel 30 has a number of advantages over a conventional barrel. First, a contoured barrel 30 is of lower mass than a conventional barrel of similar function yet remains equally reliable. Where much of the thickness and mass of a conventional barrel is to strengthen the barrel from damage due to dropping or other rough handling, the contoured barrel 30 is protected from such damage by the barrel shroud 21 and the viscoelastic dampening material 40, which weigh less than the barrel material displaced from the contoured barrel 30. Second, as previously described, the one or more parallel barrel walls 34, plurality of grooves 38, and one or more barrel steps 36 increase acoustic scatter, loss, and impedances. Third, testing has demonstrated that the viscoelastic barrel dampener minimizes catastrophic, and potentially lethal, failure of a barrel that has been obstructed. The barrel 30, including the parallel barrel walls 34, grooves 38, and barrel steps 36, may be formed by forging, machining, electrical discharge machining, milling, etching, or any suitable process.

Figure 6:
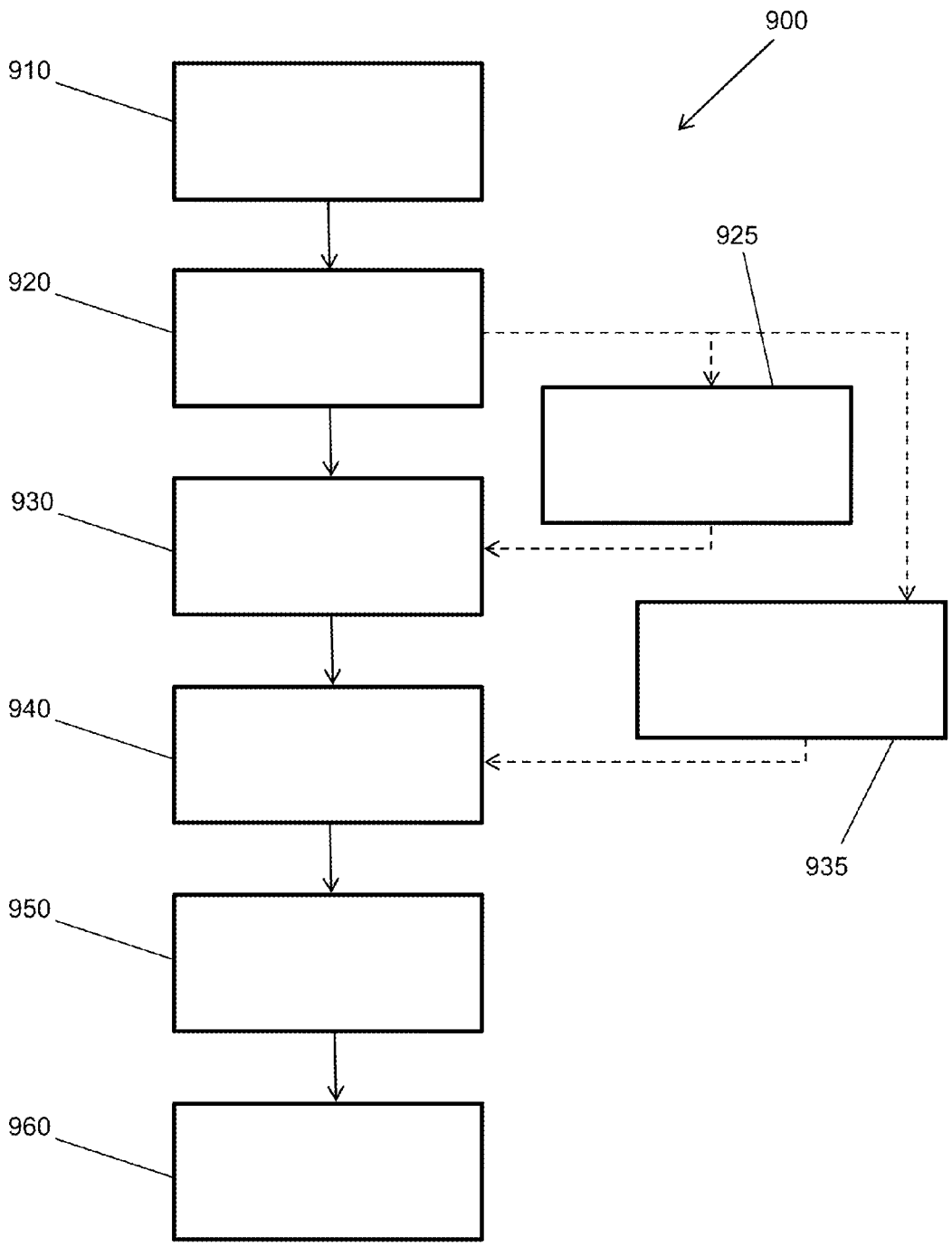
FIG. 6 shows a process flow diagram of a method for fabricating a viscoelastic barrel dampener, according to at least one embodiment of the present disclosure.

In at least one embodiment according to the present disclosure, a viscoelastic barrel dampener 20 may be fabricated by a process 900 shown in FIG. 6. The process 900 may include a step 910 of fabricating a contoured barrel 30, including the plurality of parallel barrel walls 34, the plurality of grooves 38, and one or more barrel steps 36. The process 900 may include a step 920 of forming a substantially cylindrical barrel shroud 21, which defines the chamber 24. The process 900 may further include a step 930 of injecting a prescribed amount of viscoelastic dampener material 40 into the chamber 24. The prescribed amount of viscoelastic dampener material 40 may be selected such that the chamber 24 is substantially filled with viscoelastic dampener material 40 after the contoured barrel 30 is inserted therein. The process 900 may further include a step 940 of inserting the contoured barrel 30 into the chamber 24, thereby displacing a quantity of the viscoelastic dampener material 40 and substantially filling the volume of the chamber 24. The process 900 may include a step 950 of allowing the viscoelastic dampener material 40 to cure in situ. The process 900 may further include a step 960 of attaching the shroud cap 60 to the muzzle end 12 of the barrel 30 to compress the shroud 21 against the shoulder 39 during curing of the viscoelastic dampening material 40, thereby applying axial tensile force to the barrel 30 during and after the curing. Alternatively, the step 960 may include attaching one or more tension devices 62 between the shroud cap 60 and the barrel 30 or between the shroud cap 60 and a compensator attached to the muzzle end 12.

In at least one embodiment, the process 900 may include a step 925 of applying uncured viscoelastic dampener material 40 to the surface 32 of the barrel 30 prior to insertion of the barrel 30 into the barrel shroud 21 to preclude the formation and isolation of air bubbles between the one or more parallel barrel walls 34, the plurality of grooves 38, and one or more barrel steps 36 during insertion of the barrel 30 into the barrel shroud 21. Such air bubbles may impair the transmittance of acoustic energy into the viscoelastic dampener material 40 and so should be minimized. In at least one embodiment, the process 900 may alternatively include a step 935 of encasing the contoured barrel 30 with a barrel shroud 21, thereby defining the chamber 24 between the shroud surface 22 and the barrel 30, into which the viscoelastic dampener material 40 may be injected and allowed to cure.

EXEMPLARY EMBODIMENTS

By way of nonlimiting examples, a Scout Recon Stealth rifle (Desert Tactical Arms, PO Box 65816, Salt Lake City, Utah 84165) using 338 Lapua Magnum ammunition was tested with a conventional production barrel, then retrofitted and retested using an embodiment of a viscoelastic barrel dampener according to the disclosure of U.S. patent application Ser. No. 12/727,074 that included only the barrel shroud 21 and dampening material 40, (labeled "Embodiment A"), and then retrofitted and retested again using an embodiment of a viscoelastic barrel dampener 20 according to the present disclosure, which included the contoured barrel 30 having a one or more parallel barrel walls 34, a plurality of grooves 38, and a barrel step 36, the shroud cap 60, and conical spring washer tension device 62 (labeled "Embodiment B"). Match ammunition designed for exceptional consistency and symmetry in combination with precisely weighed propellant powders assembled by repeatable methods with little variation were used to test each configuration.

Figure 7:
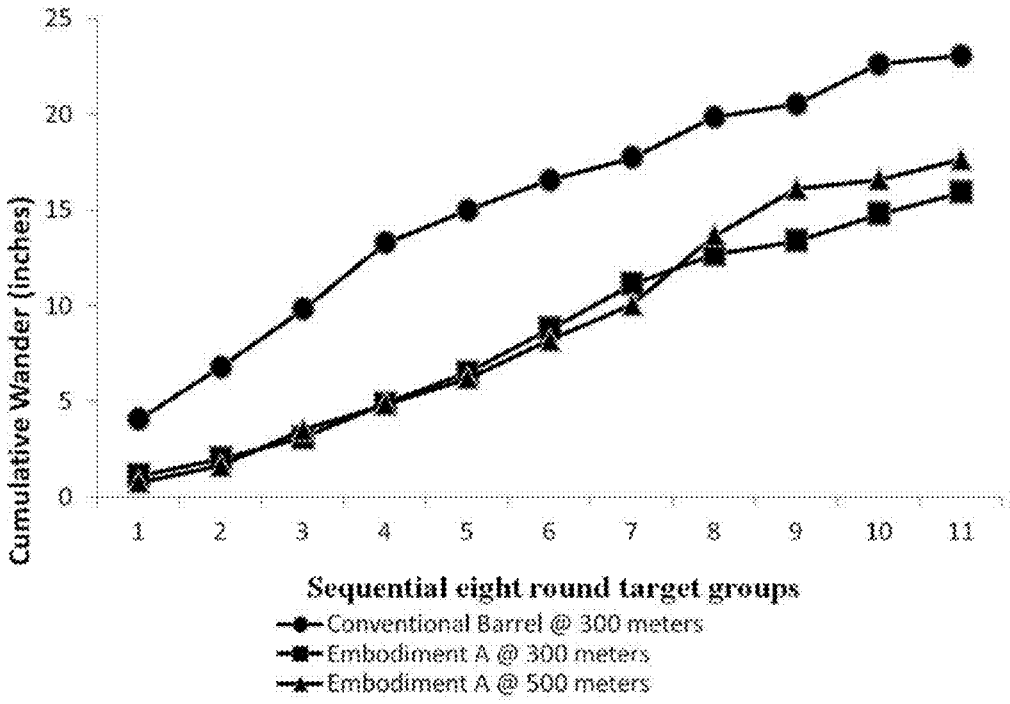
FIG. 7 presents a graphical comparison of cumulative wander, as measured in inches, of a conventional weapon barrel with a viscoelastic barrel dampener at two different ranges, according to at least one embodiment of the present disclosure.
Figure 8:
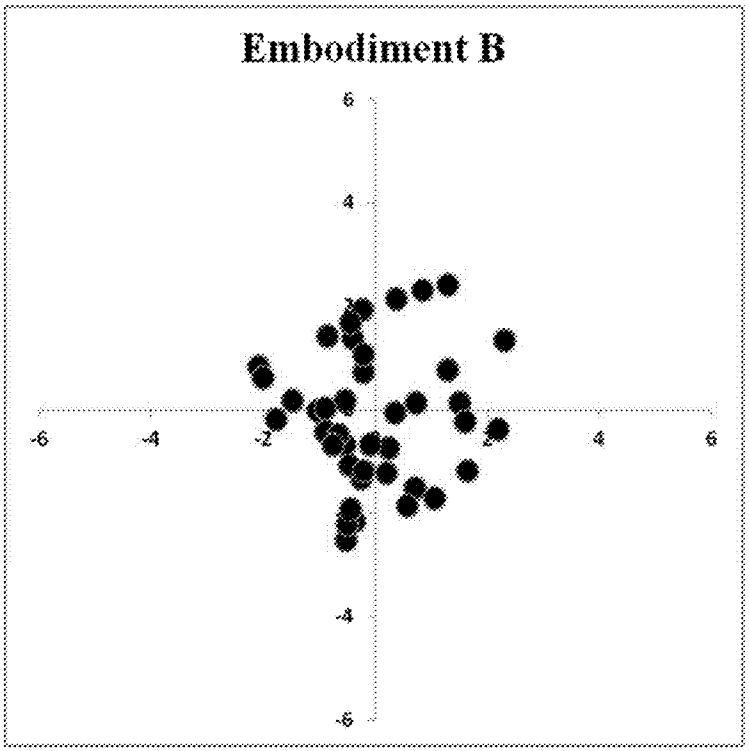
FIG. 8 presents a graphical comparison of two targets at a range of 300 meters, one shot with an embodiment according to the disclosure in U.S. patent application Ser. No. 12/727,074, and the other with an embodiment of a viscoelastic barrel dampener according to the present disclosure.
Figure 8:
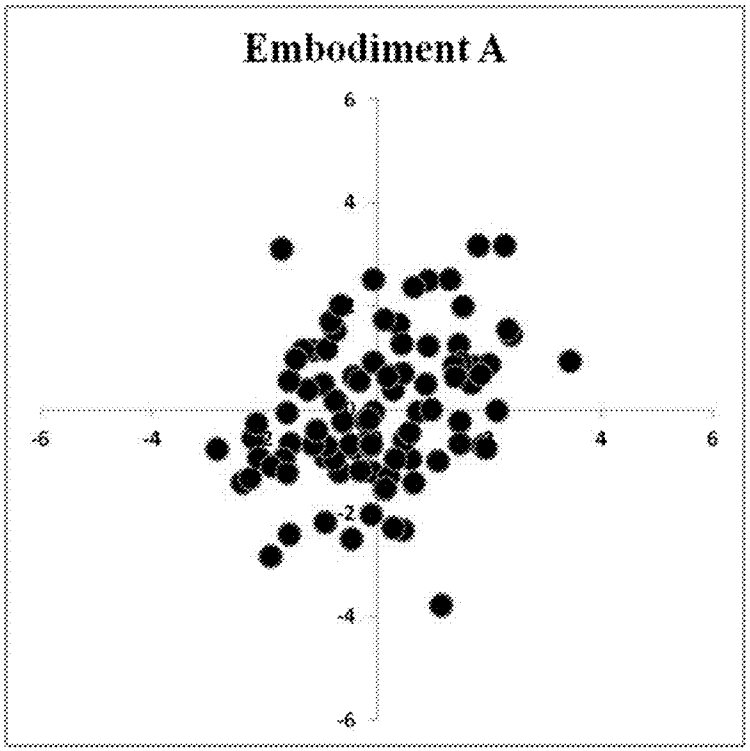
Figure 9:
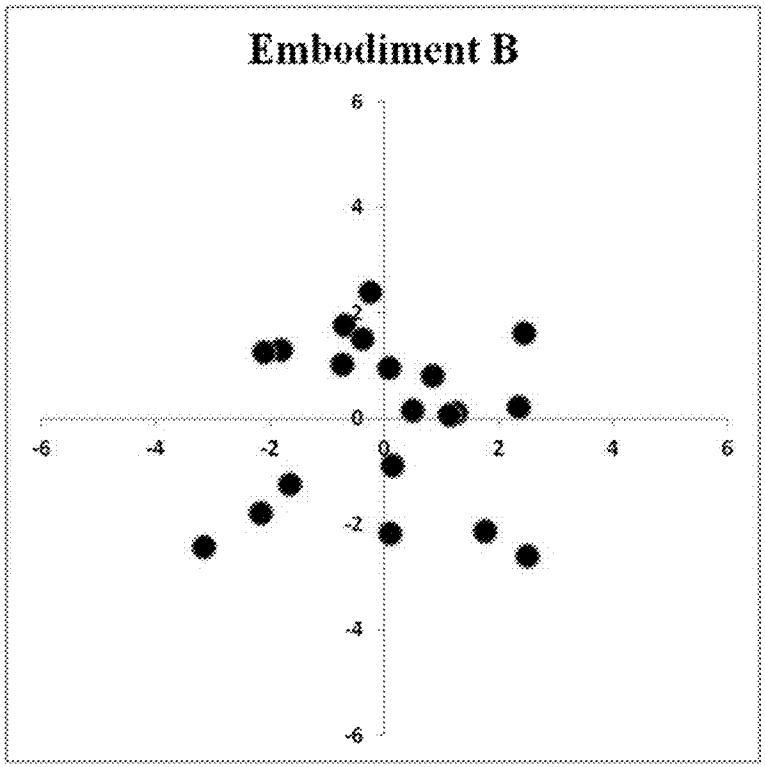
FIG. 9 presents a graphical comparison of two targets at a range of 500 meters, one shot with an embodiment according to the disclosure in U.S. patent application Ser. No. 12/727,074, and the other with an embodiment of a viscoelastic barrel dampener according to the present disclosure.
Figure 9:
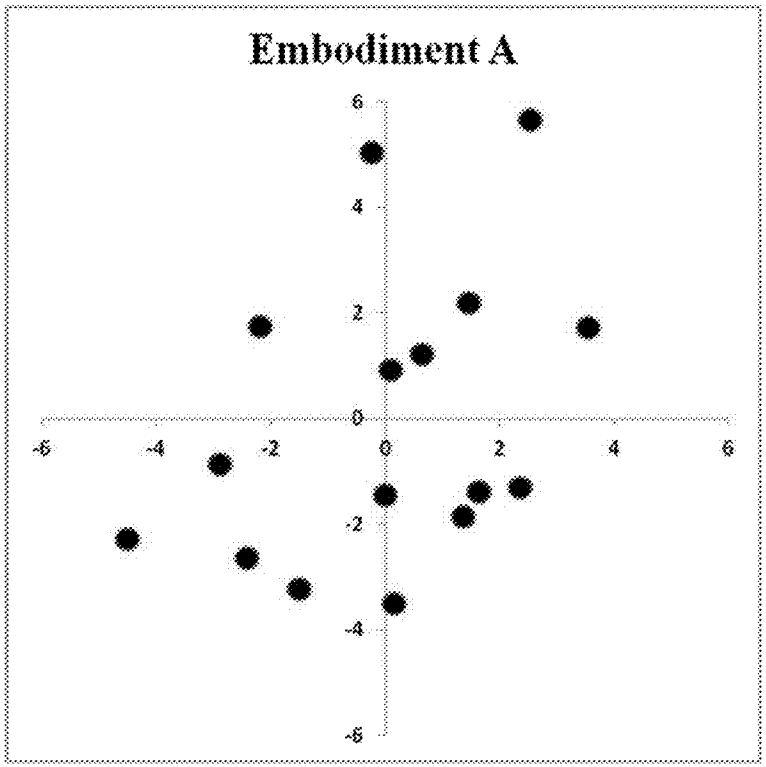

As shown in FIGS. 7-9, a viscoelastic barrel dampener 20 improves the "wander" performance of a weapon. Wander, as the term is used herein with respect to weapon performance characteristics, is the tendency of a barrel to shift its point of aim as a function of temperature. The data presented in FIG. 7 compares the cumulative degree of wander (as measured in inches) for the virtual center of eleven sequential targets of eight round groupings for different rifle configurations at multiple test ranges. As shown in FIG. 7, a conventional production barrel was compared against Embodiment A, both tested at a test range of 300 meters (m) (984 feet). In addition, Embodiment A was tested at a test range of 500 m.

FIGS. 8 and 9 presents scatter patterns for Embodiment A compared to Embodiment B, both tested at ranges of 300 meters (m) (984 feet) and 500 m (1640.4 feet). As shown in FIG. 8, the scatter pattern of Embodiment B produced a significantly tighter distribution than that of Embodiment A when tested at 300 m. Likewise, as shown in FIG. 9, the scatter pattern of Embodiment B produced a significantly tighter distribution than that of Embodiment A when tested at 500 m.

Three effects are demonstrated in the data. First, Embodiment A demonstrated less cumulative wander at both 300 m and 500 m than a conventional production barrel at 300 m. Second, the cumulative wander of Embodiment A was nearly independent of range, noting that the results are very similar at both test ranges, 300 m and 500 m. Typically, wander increases proportional to the increase in range. Therefore, the viscoelastic barrel dampener produces an unexpected improvement in the wander performance of a weapon compared to a conventional production barrel. Third, the viscoelastic barrel dampener 20 of Embodiment B, which included a contoured barrel 30 and tension device 62, demonstrated improved performance over Embodiment A, which did not include a contoured barrel 30 or tension device 62.

Table 1 presents typical results of the same rifle configurations and test ranges as FIGS. 7-9. The results presented in Table 1 demonstrate significant improvements in dispersion, accuracy, and repeatability (i.e., precision) using a viscoelastic barrel dampener 20 with a contoured barrel 30 over a conventional barrel. The primary measure of improvement is based on a United States military standard of accuracy called radial mean dispersion ("RMD"). The RMD measure is the average of each shot's distance from the virtual center of a target as defined by the relative positions on the target of all the shots. It should be noted that mean radial dispersions of 76.2 to 114.3 mm (3.0 to 4.5 in.) are considered good for most military grade precision or sniper-qualified, small bore weapons at a test range of 300 m. Table 1 presents RMD data for the different weapon configurations at 300 m and 500 m, including a conventional production barrel, Embodiment A and Embodiment B. The data confirms the improvement in performance as measured by RMD of both viscoelastic barrel dampener embodiments over the conventional production barrel, using Embodiment A as a baseline. Furthermore, Embodiment B demonstrated superior performance compared to Embodiment A, thereby indicating that a viscoelastic barrel dampener 20 is improved by a contoured barrel 30 with tension device 62.

TABLE 1

| Test Configuration | Range (m) | RMD (in.) | RMD Improvement | Standard Deviation (in.) | Standard Deviation Improvement | Average Muzzle Velocity (ft/sec) |
|---|---|---|---|---|---|---|
| Conventional Barrel | 300 | 1.91 | −17% | 1.10 | −32% | 2738 |
| Embodiment A | 300 | 1.63 | baseline | 0.84 | baseline | 2758 |
| Embodiment B | 300 | 1.55 | 5% | 0.63 | 24% | — |
| Embodiment A | 500 | 2.54 | baseline | 1.34 | baseline | — |
| Embodiment B | 500 | 2.02 | 20% | 0.93 | 30% | — |

Table 1 further presents data indicating that the viscoelastic barrel dampener 20 improves the average muzzle velocity of projectiles upon firing the weapon. The improvement presented was confirmed as statistically significant using Kolmogorov-Smirnov statistical testing.

In addition to the abovementioned improvements in weapon precision, the viscoelastic barrel dampener 20 according to at least one embodiment of the present disclosure resulted in a significant reduction in the maximum external barrel temperature. In particular, the maximum external barrel temperature was reduced an average of 34%. Such an external temperature reduction will, at the very least, reduce the infrared signature of the weapon and increase the survival probability of any soldier using the viscoelastic barrel dampener 20. Moreover, a reduction in barrel temperature may further improve the precision of a rifle's aim-point, which depends on the barrel temperature. Further, a reduction in barrel temperature may improve a barrel's long-term durability and reliability, which are also temperature dependent.

In addition to the above mentioned improvements in weapon precision, the viscoelastic barrel dampener 20 according to at least one embodiment of the present disclosure demonstrated a significant improvement in bullet yaw, which can also significantly affect overall weapon accuracy. Disturbances of the barrel in operation may effect a sideways motion in a projectile as it leaves a barrel under vibration. Testing of one such embodiment on saboted ammunition fired from a smoothbore shotgun showed a 53% improvement in overall projectile stability. A reduction in projectile yaw will inherently improve accuracy but will also enable improved penetration of projectiles at range, such as long-rod penetrators for tank cannon, because any sideways motion may cause such projectiles to strike a target at an angle, thereby decreasing the penetrating effectiveness of the projectile.

While various embodiments of viscoelastic barrel dampener and methods for using the same have been described in considerable detail herein, the embodiments are merely offered by way of non-limiting examples of the disclosure described herein. It will therefore be understood that various changes and modifications may be made, and equivalents may be substituted for elements thereof, without departing from the scope of the disclosure. Indeed, this disclosure is not intended to be exhaustive or to limit the scope of the disclosure. For instance, it is anticipated that a viscoelastic barrel dampener as disclosed herein will produce similar results on other barrels beyond conventional small firearms. For example, tank cannon, artillery barrels, and potentially electromagnetic rail gun applications are anticipated to behave similarly, and the viscoelastic barrel dampener 20 is intended to encompass applications thereon.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A viscoelastic barrel dampener, the viscoelastic barrel dampener comprising:

a shroud, the shroud defining a shroud wall and a chamber within the shroud wall;

a barrel, the barrel disposed within the chamber of the shroud and defining a barrel wall having an outer surface; and a viscoelastic dampening material, the viscoelastic dampening material disposed within and substantially filling a volume defined by the outer surface of the barrel and the shroud wall, wherein the barrel further comprises one or more contour features adapted to disrupt the axial propagation of acoustic energy along the barrel wall.

2. A viscoelastic barrel dampener of claim 1, wherein the one or more contour features comprise the barrel wall having one or more sections of uniform thickness.

3. A viscoelastic barrel dampener of claim 1, wherein the one or more contour features comprise a plurality of radial, spiral, and/or axial grooves formed in the outer surface.

4. A viscoelastic barrel dampener of claim 1, wherein the one or more contour features comprise one or more barrel steps formed in the outer surface.

5. A viscoelastic barrel dampener of claim 1, wherein the one or more contour features are further capable of decreasing an acoustic reflectivity of the outer surface and increasing a transmittance of acoustic energy to the viscoelastic dampening material.

6. A viscoelastic barrel dampener of claim 1, further comprising:

a shroud cap attached to the barrel at a muzzle end of the barrel, whereby the shroud cap applies an axial tensile force to the barrel and an opposing axial compressive force to the shroud wall.

7. A viscoelastic barrel dampener of claim 6, further comprising:

one or more tension devices disposed between the shroud and the shroud cap, whereby the one or more tension devices maintain tension in the barrel over a range of operating temperatures.

8. A viscoelastic barrel dampener of claim 1, wherein the viscoelastic dampening material attenuates a spectrum of vibrational frequencies generated by the barrel in operation.

9. A viscoelastic barrel dampener of claim 8, wherein the viscoelastic dampening material is an elastomeric polymer exhibiting hysteresis in response to being deformed.

10. A viscoelastic barrel dampener of claim 9, wherein the viscoelastic dampening material is selected from a group consisting of epoxy and polysulfide polymers.

11. The viscoelastic barrel dampener of claim 9, wherein the viscoelastic dampening material is introduced into the volume defined by the outer surface of the barrel and the shroud wall in an unpolymerized state and allowed to cure in situ.

12. A viscoelastic barrel dampener, the viscoelastic barrel dampener comprising:

an outer member defining a chamber and an outer surface;

a weapon barrel, with an exterior surface, disposed within the chamber of the outer member, wherein the outer member is sized to substantially enwrap the barrel and is adapted to provide a constraining layer; and a viscoelastic dampening material substantially filling a volume defined within the chamber of the outer member between the outer surface and the exterior surface of the barrel, wherein the viscoelastic dampening material is capable of attenuating acoustic vibrational energy across a spectrum of vibrational frequencies generated by the barrel in operation via elastic hysteresis properties of the viscoelastic dampening material, and wherein the exterior surface of the barrel comprises one or more contour features adapted to disrupt the axial propagation of acoustic energy along the barrel, the one or more contour features include a plurality of radial, spiral, and/or axial grooves and one or more steps.

13. A viscoelastic barrel dampener of claim 12, wherein the one or more contour features comprise the barrel wall having one or more sections of uniform thickness.

14. A viscoelastic barrel dampener of claim 12, wherein the one or more contour features are further adapted to decrease the acoustic reflectivity of the outer surface and increase the transmittance of acoustic energy to the viscoelastic dampening material.

15. A viscoelastic barrel dampener of claim 12, further comprising:

a shroud cap attached to the barrel at a muzzle end of the barrel, whereby the shroud cap applies an axial tensile force to the barrel and an opposing axial compressive force to the shroud wall.

16. A viscoelastic barrel dampener of claim 15, further comprising:

one or more tension devices disposed between the shroud and the shroud cap, whereby the one or more tension devices maintain tension in the barrel over a range of operating temperatures.

17. A viscoelastic barrel dampener of claim 15, further comprising:

one or more tension devices disposed between the shroud cap and a compensator attached at the muzzle end of the barrel, whereby the one or more tension devices maintain tension in the barrel over a range of operating temperatures.

18. A viscoelastic barrel dampener of claim 12, wherein the viscoelastic dampening material is an elastomeric polymer.

19. A weapon, the weapon comprising:

a viscoelastic barrel dampener, the viscoelastic barrel dampener comprising:

a shroud, the shroud defining a shroud wall and a chamber within the shroud wall, a barrel, the barrel disposed within the chamber of the shroud and defining a barrel wall having an outer surface, and a viscoelastic dampening material, the viscoelastic dampening material disposed within and substantially filling a volume defined by the outer surface of the barrel and the shroud wall, wherein the barrel further comprises one or more contour features capable of decreasing an acoustic reflectivity of the outer surface and increasing a transmittance of acoustic energy to the viscoelastic dampening material.

20. The weapon of claim 19, wherein the weapon is a rifle.

* * * * *